US005443085A

United States Patent [19]

Huddas

[11] Patent Number: 5,443,085

[45] Date of Patent: Aug. 22, 1995

[54] CLEANING APPARATUS AND METHOD FOR FUEL AND OTHER PASSAGES

[75] Inventor: Richard V. Huddas, Grand Haven, Mich.

[73] Assignee: Fuel Systems Textron, Inc., Zeeland, Mich.

[21] Appl. No.: 627,713

[22] Filed: Apr. 14, 1994

Related U.S. Application Data

[62] Division of Ser. No. 97,456, Jul. 26, 1993, Pat. No. 5,339,845.

[51] Int. Cl.[6] ..... B08B 3/04

[52] U.S. Cl. ..... 134/95.1; 134/98.1; 134/99.1; 134/103.1

[58] Field of Search ..... 134/95.1, 98.1, 99.1, 134/103.1, 169 R, 169 A, 170

[56] References Cited

U.S. PATENT DOCUMENTS

| | | | |
|---|---|---|---|
| 1,948,480 | 2/1934 | Schicht | 134/169 R X |
| 2,380,604 | 7/1945 | Melton | 134/169 R X |
| 2,644,472 | 7/1953 | Ward | 134/56 |
| 3,049,302 | 8/1962 | Simmons, Jr. | 134/99.1 X |
| 3,121,026 | 2/1964 | Beigay et al. | 134/2 |
| 3,448,745 | 6/1969 | Seeley | 134/169 R X |
| 3,693,640 | 9/1972 | Wettlen et al. | 134/169 R |
| 4,134,777 | 1/1979 | Borom | 134/2 |
| 4,141,781 | 2/1979 | Greskovich et al. | 156/637 |
| 4,161,979 | 7/1979 | Stearns | 134/169 A X |
| 4,439,241 | 3/1984 | Ault et al. | 134/22.17 |
| 4,804,005 | 2/1989 | Hartopp | 134/169 A X |
| 4,991,608 | 2/1991 | Schweiger | 134/169 A X |
| 5,090,458 | 2/1992 | Creeron | 134/169 A X |
| 5,201,958 | 4/1993 | Breunsbach et al. | 134/98.1 X |
| 5,295,497 | 3/1994 | Skovron | 134/169 A |
| 5,329,950 | 7/1994 | Barinas | 134/98.1 X |

OTHER PUBLICATIONS

FNC-100 An Aircraft Engine Maintenance Breakthrough, Lewis Corporation Case History on Jet Engine Fuel Nozzle Cleaning; 5 pages, Form No. 19D/5M, revised Oct. 1989.

Ultrasonic Fuel Nozzle Cleaning Unit, Series 9479; Woodward Governor Company, Bauer Aerospace, 1 page.

*Primary Examiner*—Philip R. Coe

*Attorney, Agent, or Firm*—Edward J. Timmer

[57] ABSTRACT

Apparatus for cleaning an internal passage of an article, such as a fuel passage of a gas turbine or other engine. The apparatus comprises a container for containing cleaning fluid, means for communicating a first end of the passage to the cleaning fluid in the container, and cleaning fluid conduit means communicated to a second end of the passage in a manner to draw cleaning fluid from the container to flow through the passage from the first end toward the second end in response to flow of cleaning fluid through the conduit means. The apparatus includes means for blocking flow of cleaning fluid through the conduit means so as to direct the cleaning fluid therein to flow through the passage from the second end toward the first end and into the container.

3 Claims, 3 Drawing Sheets

CLEANING APPARATUS AND METHOD FOR FUEL AND OTHER PASSAGES

This is now U.S. Pat. No. 5,339,845a division of Ser. No. 08/097 456, filed Jul. 26, 1993, now U.S. Pat. No. 5,339,845.

FIELD OF THE INVENTION

The present invention relates to apparatus and methods for cleaning of internal passages of articles of manufacture, especially fuel passages of fuel injection devices for gas turbine and other engines to remove coke or other deposits therefrom.

BACKGROUND OF THE INVENTION

During use, fuel injection nozzles of gas turbine engines are known to develop deposits of what is called coke in the fuel passages proximate the engine combustor; i.e. in the fuel discharge passages proximate the nozzle discharge tip that is exposed to the combustor for discharging fuel thereto. The coke deposits are formed proximate the nozzle fuel discharge tip by action of combustor heat on stagnant fuel residing in the fuel passages communicating with the combustor to carbonize the fuel to coke. For example, fuel residing in the primary fuel passages can be carbonized to form deposits of coke after engine shutdown when non-flowing fuel residing in the primary fuel passages is baked by the combustor heat. During engine operation, primary fuel flow through the primary passages is typically continuous such that coking does not occur during engine operation.

On the other hand, fuel in the secondary fuel passages can be carbonized to form deposits of coke during and after engine shutdown. In particular, secondary fuel is sometimes interrupted during engine operation such that there is non-flowing fuel present in the secondary fuel passages. The secondary fuel can be baked by the combustor heat in this situation to form coke deposits. Moreover, fuel residing in the secondary fuel passages also can be carbonized to form deposits of coke after engine shutdown when non-flowing fuel resides in the secondary fuel passages and is baked by the combustor heat to form coke deposits.

The formation of coke deposits in the primary and/or secondary fuel passages proximate the nozzle fuel discharge tip occurs over time and adversely affects performance of the fuel injection nozzle. Moreover, coke deposits also form on external tip surfaces exposed to the engine combustor. As a result, fuel injection nozzles are periodically removed from the engine and subjected to a cleaning operation to remove the coke deposits from the fuel passages.

A typical cleaning procedure heretofore employed involved fixturing a cleaning device on the nozzle fuel discharge tip and submerging the nozzle in an ultrasonically activated bath of cleaning solution such as an caustic aqueous solution. Periodically, the cleaning solution is pumped from the fixture on the nozzle discharge tip toward the fuel inlet fittings of the fuel injection nozzle in a manner that the cleaning solution flows in the opposite direction of normal fuel flow through the nozzle fuel passages. The cleaning solution is formulated to dissolve coke deposits present in the fuel passages. The nozzle can be subjected to a further cleaning in another less caustic solution contained in a separate cleaning tank and finally to a water rinse of the fuel passages in a separate rinsing tank.

The aforementioned cleaning procedure is disadvantageous in several respects. For example, fixturing of the cleaning device on the nozzle fuel discharge tip exposes this critical, close tolerance region of the fuel injection nozzle to possible mechanical damage. Moreover, when the cleaning device is actuated to pump cleaning solution through the fuel passages, the flow of cleaning solution through the primary fuel passages may not be adequate for removal of coke deposits therein as a results of the considerably smaller cross-sectional dimension of the primary passages as compared to the secondary fuel passages. That is, the cleaning solution flows through the larger sized secondary fuel passages preferentially to the smaller primary fuel passages. Inadequate cleaning of the primary fuel passages can result. Furthermore, the cleaning solution is pumped through the fuel passages only from the discharge tip end of the fuel injection nozzle toward the inlet fittings thereof. Unless the fuel injection nozzle is again fixtured to connect the inlet fittings to the cleaning solution source, there is no pressurized cleaning solution flow in the opposite direction. In addition, the cleaning procedure is carried out using a series of separate cleaning tanks for different cleaning solutions that may be employed and separate rinse tanks. This complicates the cleaning apparatus and requires transporting the fuel injection nozzles from one cleaning or rinsing tank to another such that there is excessive handling of the nozzles during the cleaning operation.

It is an object of the present invention to provide a cleaning apparatus and method for cleaning one or more internal passages of an article of manufacture wherein fixturing on a critical, close tolerance region of the article (e.g. on a fuel nozzle tip) during the cleaning operation is avoided.

It is another object of the present invention to provide a cleaning apparatus and method for cleaning one or more internal passages of an article of manufacture wherein adequate flow of cleaning fluid can be provided through differently sized internal passages to provide proper cleaning of all of the passages.

It is still another object of the present invention to provide a cleaning apparatus and method for cleaning one or more internal passages of an article of manufacture wherein flow of cleaning fluid through the internal passages can be reversed.

It is still a further object of the present invention to provide a cleaning apparatus and method for cleaning one or more internal passages of an article of manufacture wherein cleaning and rinsing of the internal passages can be conducted using a common tank or container.

SUMMARY OF THE INVENTION

The present invention provides apparatus for cleaning an internal passage of an article, such as a fuel passage of a gas turbine or other engine. The apparatus comprises a container for cleaning fluid, means for communicating a first end of the passage to the cleaning fluid, and cleaning fluid conduit means communicated to a second end of the passage in a manner to draw cleaning fluid from the container to flow through the passage from the first end toward the second end in response to flow of cleaning fluid through the conduit means. The apparatus includes means for blocking flow of cleaning fluid through the conduit means so as to direct the cleaning fluid therein to flow through the passage from the second end toward the first end and into the container.

In one embodiment of the invention, the means for communicating the first end of the passage to the cleaning fluid comprises fixture means for positioning the article relative to the container to immerse the first end in the fluid. The fixture means can engage the article at a non-critical region.

In another embodiment of the invention, the cleaning fluid conduit means is communicated to the second end of the passage by a vacuum-generating device for establishing a subambient pressure at the second end sufficient to draw the cleaning fluid from the container means through the passage from the first end toward the second end.

In another embodiment of the invention, the vacuum-generating device is a venturi device having a discharge end communicated to the second end by a conduit extending between the venturi discharge end and the second end of the passage. The means for blocking flow of cleaning fluid through the conduit means is disposed downstream of the vacuum-generating device.

In still a further embodiment of the invention, the means for supplying cleaning fluid to the conduit means comprises cleaning fluid recirculating means connected to the container for withdrawing cleaning fluid therefrom and supplying it to the conduit means. The recirculating means includes a transfer pump for withdrawing fluid from the container and a booster pump in communication with the transfer pump to supply the fluid at a higher pressure to an internal passage of the article while an external surface of the article remains in contact with the fluid in the container.

In a working embodiment of the invention for cleaning a fuel passage of a gas turbine engine fuel injection device having a fuel inlet fitting for supplying fuel to the passage and a fuel discharge orifice for discharging fuel from the passage to an engine combustor, the apparatus comprises fixture means for engaging a region of the nozzle other than the discharge tip and positioning the fuel discharge orifice in the cleaning fluid, cleaning fluid conduit means communicated the inlet fitting in a manner to draw cleaning fluid from the container into the passage through the fuel discharge orifice in response to flow of cleaning fluid through the conduit means, and means for blocking flow of cleaning fluid through the conduit means so as to direct the cleaning fluid therein to flow into the passage through the fuel inlet fitting and into the container through the fuel discharge orifice.

Preferably, the means for communicating the fuel discharge orifice to the cleaning fluid comprises fixturing means for engaging a flange of the fuel injection device located between the fuel inlet fitting and a fuel discharge tip of the fuel injection device. The fuel injection device is positioned such that the fuel discharge tip is immersed in the cleaning fluid.

The above and other objects and advantages of the invention will become more fully apparent from the following drawings and detailed description.

DETAILED DESCRIPTION

The present invention is described herebelow and is especially useful with respect to the cleaning of fuel injection nozzles to remove coke (carbonized fuel) from the primary and/or secondary fuel passages after use in a gas turbine engine. However, the invention is not so limited and can be practiced to clean one or more internal passages of other types of fuel injection devices for engines as well as other diverse articles of manufacture.

Figure 1:
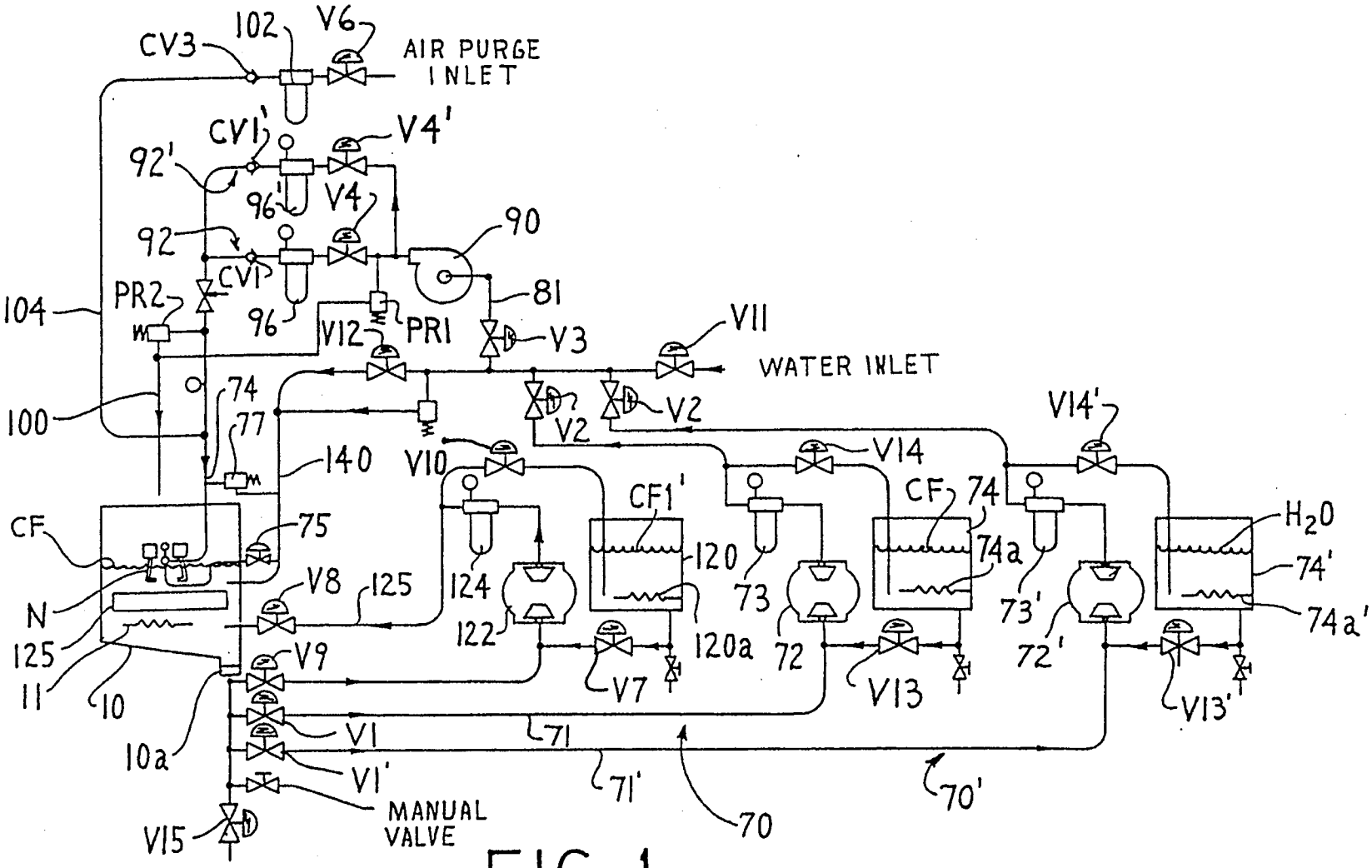
FIG. 1 is a schematic view of cleaning apparatus in accordance with one embodiment of the invention for cleaning one or more gas turbine engine fuel injection nozzles.
Figure 2:
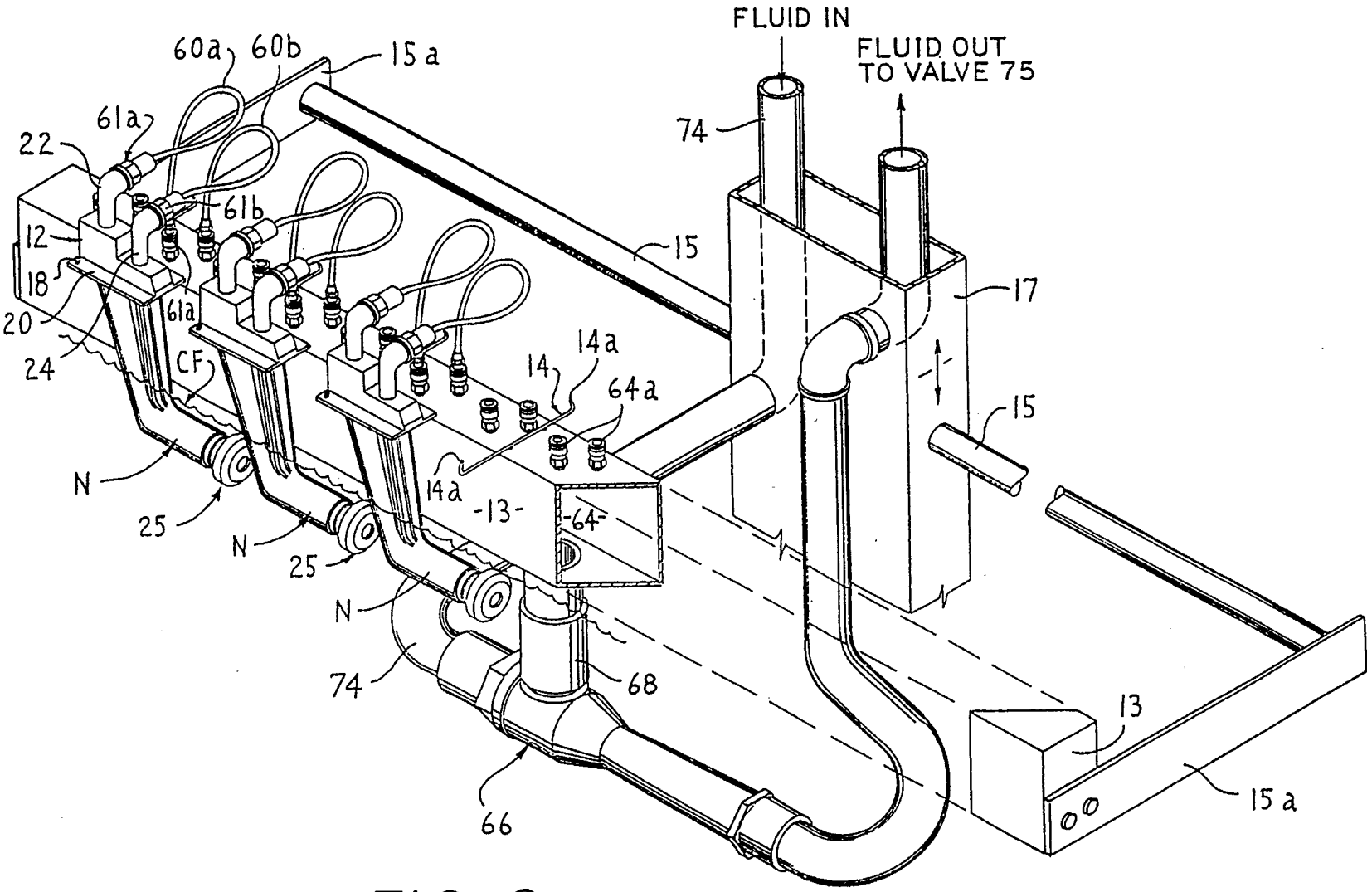
FIG. 2 is a perspective view of the cleaning container and the fixture used to position the fuel injection nozzles for cleaning.
Figure 3:
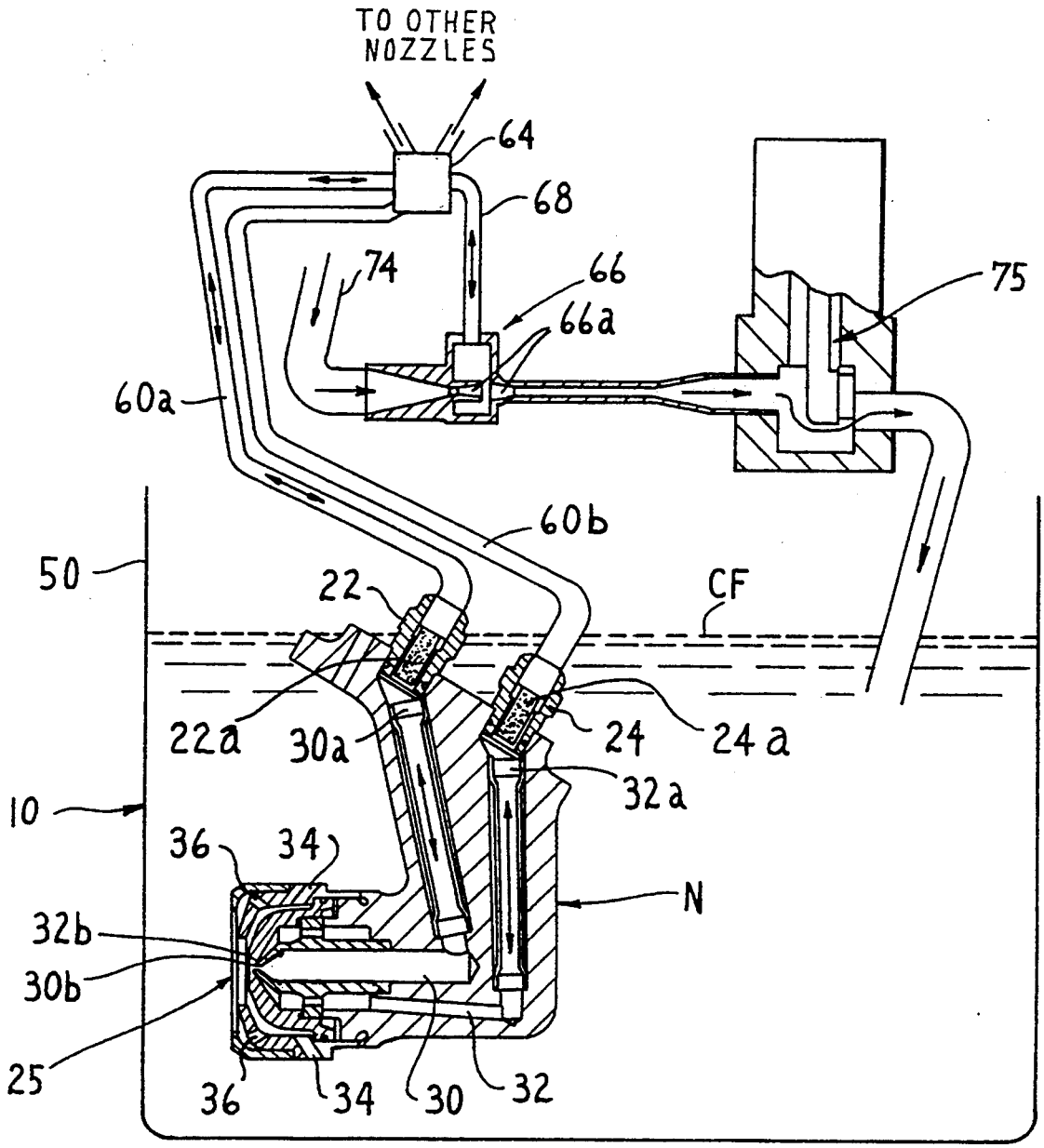
FIG. 3 is a partial enlarged schematic view of the cleaning apparatus of FIG. 1 showing certain invention components as well as a valveless fuel injection nozzle to be cleaned in greater detail. The invention components are shown out of normal position for purposes of clarity. For example, the manifold 64 and vacuum-generating device 66 are normally disposed in the container 10.

Referring to FIGS. 1–3, apparatus in accordance with one embodiment of the invention is illustrated for cleaning fuel injection nozzles N to remove coke (carbonized fuel) from the primary and/or secondary internal fuel passages as well as from the external nozzle tip surfaces after use in a gas turbine engine. In particular, a plurality of fuel injection nozzles N are shown positioned in a cleaning vessel or container 10 by fixture means 12 shown in more detail in FIG. 2. The fixture means 12 comprises an elongated, hollow beam 13 supported on support arms 15 (partially shown in FIG. 2) that include opposite end flanges 15*a* supporting opposite ends of the beam 13 so that it is located lengthwise of the container 10. The beam 13 includes a plurality of hook members 14 spaced apart along the length of the beam 13. Each hook member 14 includes opposite upturned hook ends 14*a* adapted to engage in a fastener hole 18 in an intermediate flange 20 of a respective fuel injection nozzle N. Thus, fuel injection nozzles N can be mounted on opposite sides of the beam 13 (FIG. 1), although, for convenience, nozzles N are shown fixtured on only one side of the beam 13 in FIG. 2. The flange 20 is disposed on the nozzle housing and is used to mount the fuel injection nozzle N to the combustor (not shown) of the gas turbine engine in well known manner.

The beam support arms 15 are mounted on a lift/-lower carriage 17 that is movable up or down by a suitable fluid actuator (not shown) to position the beam 13 in the container 10 in a desired cleaning position.

The flange 20 is located on each nozzle housing intermediate the fuel inlet fittings 22, 24 and a fuel discharge tip 25 as shown best in FIG. 2. The fuel inlet fitting 22 is adapted to be connected to a source of primary fuel (e.g. a primary fuel manifold-not shown) and the fuel inlet fitting 24 is adapted to be connected to a source of secondary fuel (e.g. a secondary fuel manifold-not shown) via suitable fuel conduits (not shown) in usual manner.

The fuel inlet fittings 22, 24 are communicated via fuel filters 22*a*, 24*a* (filter screens) to respective ends 30*a*, 32*a* (first ends) of primary and secondary internal fuel passages 30, 32. The fuel passages 30, 32 terminate proximate the tip 25 in second ends to discharge the fuel to the engine combustor (not shown). In particular, the primary fuel passage 30 terminates in a primary discharge end orifice 30*b* through which primary fuel is discharged while the secondary fuel passage 32 terminates in a secondary discharge end orifice 32*b* through which secondary fuel is discharged. As mentioned hereabove, fuel residing in regions of the primary and secondary fuel passages 30, 32 proximate the discharge orifices 30*b*, 32*b* can be carbonized by the combustor heat to form deposits of carbonized fuel (coke) in the fuel passage regions. For example, coke deposits are formed proximate the nozzle fuel discharge tip 25 by action of combustor heat on stagnant fuel residing in the primary fuel passage regions after engine shutdown when non-flowing fuel resides in the primary fuel passage regions. During engine operation, primary fuel flow through the primary passage 30 is typically continuous such that coking does not occur during engine operation.

On the other hand, fuel in the secondary fuel passage 32 can be carbonized to form deposits of coke during and after engine shutdown. In particular, secondary fuel flow is sometimes interrupted during engine operation such that there is non-flowing fuel present in the secondary fuel passages 32. The secondary fuel in the region proximate the tip 25 can be baked by the combustor heat during engine operation to form coke deposits. Moreover, fuel residing in the secondary fuel passage 32 also can be carbonized to form deposits of coke after engine shutdown when non-flowing fuel resides in the secondary fuel passage regions proximate the nozzle tip 25.

The fuel injection nozzles N include air passages 34 that receive compressor discharge air and direct it at the fuel discharged from the primary discharge orifice 30*b* to atomize the fuel. Also, air passages 36 are provided to direct compressor discharge air at the fuel discharged from the secondary fuel discharge orifice 32*b* to atomize the fuel. Fuel injection nozzles N of the type shown and described are of conventional and well known construction.

The fuel injection nozzles N illustrated do not have an internal spring biased, secondary fuel metering valve associated with the secondary fuel passage 32. These types of fuel injection nozzles N without integral fuel metering valves can be cleaned using the invention with forward/reverse flushing of the fuel passages 30, 32 as will be explained herebelow. Fuel injection nozzles having an internal, spring biased fuel metering valve in the secondary fuel passage 32 also can be cleaned in accordance with the invention. In cleaning these types of valved fuel injection nozzles, the cleaning fluid or rinse water can be forced under sufficient pressure past the spring biased fuel metering valve in the valve opening direction so as to clean the internal fuel passages 30, 32. However, the fuel passages 30, 32 cannot be forward/reverse flushed with cleaning fluid or rinsing water as a result of the presence of the spring biased metering valve in the secondary fuel passage 32. The invention is illustrated herebelow with respect to the cleaning of a valveless fuel injection nozzles N. As mentioned hereabove, the formation of coke (carbon) deposits in the regions of the primary and/or secondary fuel passage 30, 32 proximate the tip 25 occurs over time and adversely affects performance of the fuel injection nozzle. Moreover, coke deposits also form on external surfaces of the fuel discharge tip 25 exposed to the engine combustor. As a result, fuel injection nozzles are periodically removed from the engine and subjected to a cleaning operation to remove the coke deposits from the fuel passage regions and from the fuel discharge tip.

Referring to FIGS. 1–3, cleaning apparatus in accordance with the illustrated embodiment of the invention includes the cleaning vessel or container 10 in which the nozzles N are disposed for cleaning and rinsing. As is apparent, the fixture means 12 is positioned by carriage 17 to locate the fuel injection nozzles N such that the fuel discharge tips 25 are immersed in the cleaning fluid CF in the container 10 and the fuel inlet fittings 22, 24 are disposed above the upper level of the cleaning fluid CF. In this way, the fuel discharge end orifices 30*b*, 32*b* are communicated to the cleaning fluid CF in the container 10. Thus, in this embodiment of the invention, the fuel discharge end orifices 30*b*, 32*b* (first ends) are communicated to the cleaning fluid CF in the container 10 by appropriate positioning of the nozzles N via the fixture means 12 relative to the cleaning fluid in the container 10.

The fixture means 12 may be disposed on a platform (not shown) disposed on the bottom of the container 10. The platform can be movable vertically relative to the container 10 to position the nozzle tips 25 in appropriate position for cleaning; i.e. with discharge orifices 30*b*, 32*b* immersed in the cleaning fluid. The platform may include mechanical agitation means (not shown) for vibrating the nozzles N during the cleaning operation.

As shown best in FIGS. 2–3, the fuel inlet fittings 22, 24 of each fuel injection nozzle N are connected to fluid conduits 60*a*, 60*b* via one or more fittings 61*a*, 61*b* connected to the respective nozzle inlet fittings 22, 24. Each conduit 60*a*, 60*b*, in turn, is connected by a respective nipple 64*a* to a fluid manifold 64 formed within the hollow beam 13. The fluid manifold 64 is connected to a vacuum-generating device 66 by an interconnecting conduit 68. The vacuum-generating device 66 alternately can be supplied with cleaning fluid, rinsing water, or purge air by a supply conduit 74. The vacuum-generating device 66 can comprise a venturi device or ejector device having a discharge end 66*a* communicated to the fuel inlet fittings 22, 24 by the conduit 68, manifold 64, and conduit 60.

As a result, the conduit 74/vacuum-generating device 66 are connected to the fuel passages 30, 32 in a manner to draw fluid from the container 10 through the fuel passages 30, 32 when the vacuum-generating device 66 establishes a relative vacuum at the inlet fittings 22, 24 (subambient pressure relative to ambient pressure on the cleaning fluid CF in container 10) by virtue of fluid flow through the vacuum-generating device 66. In particular, a fluid (i.e. cleaning fluid or rinse water in container 10) can be caused to flow in a first direction through the discharge orifices 30*b*, 32*b* into the fuel passages 30, 32 and then through the inlet fittings 22, 24 into the conduits 60*a*, 60*b* in response to flow of fluid through the conduit 74 and thus the vacuum-generating device 66.

Fluid (i.e. cleaning fluid or rinse water in container 10) alternately can be caused to flow in a second direction opposite to the first direction through the fuel inlet fittings 22, 24 into the fuel passages 30, 32 and then through the discharge orifices 30*b*, 32*b* into the container 10 in response to blockage of flow of fluid through the conduit 74 downstream of the vacuum-generating device 66. A fluid blocking valve 75 is provided in the conduit 74 downstream of the vacuum-generating device 66 to this end as shown in FIGS. 1–2.

A flow of fluid in opposite first and second directions through the fuel passages 30, 32 thus can be provided by suitable control of blocking valve 75. Blocking valve 75 can be a pneumatic valve or electrical valve. As will be explained herebelow, this forward/reverse fluid flow is employed periodically to flush the fuel passages 30, 32 with cleaning fluid or rinse water.

The supply conduit 74 and vacuum-generating device 66 can be supplied with cleaning fluid CF during a cleaning stage of the cleaning operation by at least one cleaning fluid recirculating circuit or loop 70. The recirculating circuit or loop 70 is connected to the drain 10*a* of the cleaning container 10 by conduit 71, valve V1 and low pressure pump 72 for withdrawing cleaning fluid therefrom. The cleaning fluid is filtered via a 10 micron filter 73 disposed upstream of the pump 72. The filtered cleaning fluid then is supplied to a supply conduit 81 for return by high pressure booster pump 90 to the vacuum-generating device 66 via a supply conduit 74 at a higher pressure sufficient to provide fluid flow through the fuel passages 30, 32.

As will be explained herebelow, the supply conduit 81 is connected to the filter 73 by actuation of suitable valves V2, V3 in selected sequence. The supply conduit 81 includes the high pressure booster pump 90 (e.g. 250 psi at 15 gallons per minute) that pumps the filtered cleaning fluid to the supply conduit 74 at sufficient pressure to flow the cleaning fluid through the fuel passages 30, 32 of a plurality (e.g. 40) of nozzles N at one time. The pump 90 also is sufficiently high in pressure to effect opening of any secondary fuel metering valve that may be associated with the secondary fuel passage 32.

The pump 90 alternately supplies one of two identical feed conduits 92, 92' that can be interconnected to the supply conduit 74 by actuating suitable valves V4, V4'. Each feed conduit includes 10 micron fluid filters 96, 96' and fluid check valves CV1, CVI' as is apparent. Pressure relief valves PR1, PR2 are located at suitable locations to prevent build-up of excessive fluid pressure. The pressure relief valves PR1, PR2 allow excessive fluid pressure to be alleviated by return of cleaning fluid to the container 10 by the high pressure return conduit 100 shown in FIG. 1.

The supply conduit 74 and vacuum-generating device 66 alternately can be supplied with rinse water during a rinsing stage of the cleaning operation by a rinse water recirculating circuit or loop 70'. The rinse water recirculating loop 70' includes components like those described hereabove with respect to cleaning fluid loop 70. The like components of the rinsing water loop 70' are designated with like reference numerals primed to this end. The rinse water recirculating circuit 70' interfaces with the supply conduit 81 in the same manner as the cleaning fluid recirculating circuit 70. As is apparent, the supply conduit 81 is supplied with filtered rinse water from 10 micron filter 73' in lieu of filtered cleaning fluid from filter 73 by appropriate actuation of valves V2, V2' (i.e. valve V2 closed and valve V2' opened).

The supply conduit 81 alternately also can be supplied with tap or deionized water during a purging stage of the cleaning operation by opening valve V11, V3 and V4 or V4' (depending on which circuit was last used; CF fluid or $H_2O$ fluid).

The supply conduit 74 alternately also can be supplied with purging air (compressed shop air at 80psi) during a purging stage of the cleaning operation by a valve V6, air filter 102 and check valve CV3 in an air conduit 104 connected to the supply conduit 74 as shown in FIG. 1.

In a method embodiment for cleaning the fuel injection nozzles N to remove coke deposits, the container 10 initially is filled with a hot (e.g 280 degrees F.) cleaning fluid CF1 from storage tank 120 having heater 120*a*. The cleaning fluid CF1 supplied to container 10 from heated tank 120 can comprise CEE-BEEJ87L caustic cleaning solution available from McGean-Rohco, Inc., Downey, Calf. The cleaning solution comprises a water base solution effective to dissolve carbon (coke) deposits from external surfaces on the nozzle tip 25. The hot cleaning solution is pumped by low pressure pump 122 from the heated tank 120 into the empty container 10 to the level shown while valves V7 and V8 are open and valves V9 and V10 are closed. The cleaning solution from tank 120 passes through 10 micron filter 124 on its way to the container 10 via the fill conduit 125. The valves V7 and V8 are closed after container filling.

The fuel injection nozzles N are allowed to soak in the hot cleaning solution for a preselected time (e.g. 5 minutes) while the ultrasonic device 125 is actuated to provide high frequency(40 Khz)/high density (power density of 120 watts/gallon) sound waves proximate the nozzle tip 25 to scrub nozzle tip external and internal surfaces and break up carbon (coke) particles. The ultrasonic device 125 is located approximately 2 inches beneath the tip 25. The ultrasonic device 125 can comprise a conventional ultrasonic unit, such as a KLN unit available from Forward Technology Industries, Inc. The cleaning container 10 is heated by heater element 11 to help maintain the elevated temperature of the cleaning fluid CF1. While cleaning, fluid in the container 10 is continuously recirculated through the 10 micron filter 124 by the low pressure pump 122 with valves V8 and V9 open.

After the soaking period, the ultrasonic device 125 is deactuated. The hot cleaning solution CF1 is then returned to the tank 120 by the low pressure pump 122 with the valves V7 and V8 closed and the valves V9 and V10 open. The cleaning solution is filtered by filter 124 before it is returned to the tank 120.

After the cleaning solution CF1 is returned to the tank 120, the supply lines 140 are purged with tap water by opening valves V11 and V12 connected to the tap water source. Valves V2, V2', and V3 are closed. Tap water purges remaining cleaning solution CF1. The tap water sprays out of the fuel injector nozzle tips thereby rinsing out the container 10. The tap water is returned to the holding tank 120 that contains CF1' by the low pressure pump 122 through the 10 micron filter 124 by opening valves V9 and V10. After sufficient water is returned to the holding tank 120 to make up for evaporation as determined by a fluid level sensor (not shown), valves V9 and V10 close and remaining water is diverted to a waste holding tank (not shown) by opening valve V15. Except for water purge stage, valve V11 is normally in the closed condition.

After the tap water is removed from the container 10, the fuel passages 30, 32 of the fuel injection nozzles N are purged with compressed air to remove any remaining water therein. The air purge is effected by opening valve V6 to supply compressed shop air to supply conduit 74 and closing blocking valve 75 downstream of vacuum-generating device 66 to cause filtered shop compressed air to flow through the fuel inlet fittings 22, 24 into the passages 30, 32 and out the discharge orifices 30*b*, 32*b*. There is an orifice (not shown—approximately 0.062 inches diameter) in the valve 75 and in the relief valve 77 to allow residual fluid to be purged through the closed valves.

After the air purging stage, the now empty container 10 is filled to the level shown with a milder (less caustic) cleaning solution CF from heated storage tank 74 having heater 74*a*. The cleaning solution CF is pumped by low pressure pump 72 from the tank 74 into the empty container 10 to the level shown while valves V2, V12, V13 are open and valves V1, V3 are closed. The cleaning solution CF from tank 74 passes through filter 73 on its way to the container 10 via the fill conduit 140. The valves V2, V12, V13 are closed after container filling.

The fuel injection nozzles N are allowed to soak in the cleaning solution CF for a preselected time (e.g. 5 minutes) while the ultrasonic device 125 is actuated. The cleaning solution CF supplied to container 10 from heated tank 74 (170 degrees F.) can comprise ENDOX Q-576 cleaning caustic cleaning solution available from Enthone-OMI, Inc., New Haven, Conn. The cleaning solution comprises a water caustic solution effective to dissolve carbon (coke) deposits from internal fuel passage surfaces proximate the nozzle tip 25 without damaging any elastomeric seals that may be present in the fuel injection nozzles N. During the soak period, the cleaning solution CF in the container 10 periodically is caused to forward/reverse flush the fuel passages 30, 32. This forward/reverse flush of the fuel passages 30, 32 is effected by circulating the cleaning solution CF through the recirculating loop 70. In particular, with the valve V12 closed and valves V1, V2, V3 opened, the low pressure pump 72 pumps the cleaning fluid CF from the container 10 to the high pressure booster pump 90 via filter 73. Valve V4 is open. The booster pump 90 pumps the cleaning solution CF through the 10 micron filter 96 to the supply conduit 74 with the blocking valve 75 open to cause a reverse flow of the cleaning solution CF through the fuel passages 30, 32. The blocking valve 75 is periodically closed to cause the cleaning fluid CF to flow through the fuel inlet fittings 22, 24 into fuel passages 30, 32 and out the discharge orifices 30*b*, 32*b* into the container. For example, during a soaking period of 5 minutes, the cleaning solution CF is forward/reverse flushed through the passages 30, 32 every 5 minutes with the forward and reverse flush each occurring for 2 minute intervals. Importantly, the cleaning solution CF can be forward/reverse flushed through the fuel passages 30, 32 while the nozzle tips 25 remain fully exposed and immersed in the ultrasonic agitated cleaning solution CF.

After this cleaning stage, the ultrasonic device 125 is deactuated. The hot cleaning solution CF is then returned to the tank 74 by the low pressure pump 72 with the valves V1, V14 open and the valves V2, V13 closed. The cleaning solution CF is filtered by filter 73 before it is returned to the tank 74.

After the cleaning solution CF is returned to the tank 120, the fuel injection nozzles N are purged with tap water by opening valves V3 and V11 connected to the tap water source. Valves V2 and V12 are closed. Tap water purges remaining cleaning solution CF from all CF flow passages and the fuel injector nozzle. The tap water sprays out of the fuel injector nozzle tip(s) 25 thereby rinsing out the container 10. The tap water is returned to the holding tank 74 that contains CF by the low pressure pump 72 through the 10 micron filter 73 by opening valves V1 and V14. After sufficient water is returned to the holding tank 74 to make up for evaporation as determined by a fluid level sensor (not shown), valves V1 and V14 close and remaining water is diverted to a waste holding tank (not shown) by opening up valve V15. Except for water purge stage, valve V11 is normally in the closed condition.

After the tap water is removed from the container 10, the fuel passages 30, 32 of the fuel injection nozzles N are purged with compressed air (80 psi) to remove any remaining water therein. The air purge is effected by opening valve V6 to supply compressed shop air to supply conduit 74 and closing blocking valve 75 downstream of vacuum-generating device 66 to cause filtered shop compressed air to flow through the fuel inlet fittings 22, 24 into the passages 30, 32 and out the discharge orifices 30*b*, 32*b*. The aforementioned orifice (not shown-approximately 0.062 inches diameter) in the valve 75 and in the relief valve 77 allows residual fluid to be purged through the closed valves.

The now empty container 10 is filled to the level shown with rinse water (filtered tap water) from heated storage tank 74'. The rinse water is pumped by low pressure pump 72' from the tank 74' into the empty container 10 to the level shown while valves V2', V13' are open and valves VI', V3 are closed. The rinse water from tank 74' passes through filter 73' on its way to the container 10 via the fill conduit 140. The valves V2' and V13' are closed after container filling.

The fuel injection nozzles N are allowed to soak in the rinse water for a preselected time (e.g. 5 minutes) while the ultrasonic device 125 is actuated. The rinse water is supplied to container 10 from heated tank 74' (180 degrees F.). During the soak period, the rinse water in the container 10 periodically is caused to forward/reverse flush the fuel passages 30, 32 by circulating the rinse water through the recirculating loop 70'. In particular, with the valves V2, V12 closed and valves V1', V2', V3 opened, the low pressure pump 72' pumps rinse water form the container 10 to the pump 90 via the filter 73'. Valve V4' is open. The booster pump 90 pumps the filtered water through the 10 micron filter 96' to the supply conduit 74 with the blocking valve 75 open to cause a reverse flow of the water through the fuel passages 30, 32. The blocking valve 75 is periodically closed to cause the water to flow through the fuel inlet fittings 22, 24 into fuel passages 30, 32 and out the discharge orifices 30*b*, 32*b* into the container 10. For example, during a soaking period of 5 minutes, the rinse water is forward/reverse flushed through the passages 30, 32 every 5 minutes with the forward and reverse flush each occurring for 2 minute intervals.

After this rinsing stage, the ultrasonic device 125 is deactuated. The rinse water is then returned to the tank 74' by the pump 72' with the valves V1', V14' opened and the valves V2', V13' closed. The rinse water is filtered by filter 73' before it is returned to the tank 74'.

The rinsed fuel injection nozzles N then are purged with tap water in a similar manner as described hereabove for tap water purging of the cleaning solution CF from the fuel injection nozzles N whereby tap water sprays out of the fuel injector nozzle tip(s) 25 into the container 10.

After the tap water is removed from the container 10, the fuel passages 30, 32 of the fuel injection nozzles N are purged with compressed air in the manner described hereabove to remove any remaining water therein.

The present invention is advantageous in that one or more internal passages of the fuel injection nozzle (or other article of manufacture) can be cleaned while fixturing on the nozzle housing flange 20 without fixturing on the critical, close tolerance nozzle tip 25. Damage to the nozzle tip 25 is thereby avoided. Moreover, the fuel injection nozzles (or other article of manufacture) can be cleaned with adequate flow of cleaning fluid through the differently sized internal primary and secondary fuel passages to provide proper cleaning thereof. Still further the internal fuel passages of a fuel injection device can be cleaned using a forward/reverse cleaning fluid flow. Both valved and valveless fuel injection nozzles can be cleaned using the invention.

In addition, the invention is effective to clean one or more internal passages of fuel injection nozzles (or other articles of manufacture) using a common cleaning/rinsing container 10 and thereby avoids duplicative ultrasonics and fixtures associated with use of multiple cleaning and rinsing containers.

Since the valves V1, V2, etc. comprise control valves, the apparatus of the invention can be controlled by suitable process computer control means whereby opening/closing of the valves can be computer programmed and controlled to provide variable cleaning/-rinsing/ purging schedules. The valves V1, V2, etc. can comprise pneumatic, electric and other valve types.

Although the invention has been described in terms of specific embodiments thereof, it is understood that modifications and changes can be made thereto within the scope of the invention and appended claims.

The embodiments of the invention in which an exclusive property or privilege is claimed are defined as follows:

1. Apparatus for contacting external and internal surfaces of an article with first and second fluids, comprising:

a) a container for receiving the article, b) means for supplying a first fluid to the container to contact an external article surface, said means comprising a storage tank for said first fluid, conduit means for connecting the storage tank to the container, and a first transfer pump for transferring the first fluid between the container and the tank, c) means for supplying a second fluid to the container after the first fluid is returned to the first storage tank for contacting an external article surface, said means comprising a storage tank for said second fluid, conduit means for connecting the storage tank to the container, and a second transfer pump for transferring the second fluid between the container and the tank, and d) a booster pump alternately communicable to the respective first and second transfer pumps for supplying the respective first and second fluid therefrom at a pressure to an internal surface of the article while the external surface thereof contacts the respective first and second fluid in the container.

2. The apparatus of claim 1 wherein the first storage tank contains a cleaning fluid and the second storage tank contains rinse water,

3. The apparatus of claim 1 wherein the booster pump is communicable to the respective first and second transfer pumps by respective first and second electrically actuated valves.

* * * * *